US008534079B2

(12) United States Patent
Brooks

(10) Patent No.: US 8,534,079 B2
(45) Date of Patent: Sep. 17, 2013

(54) FREEZER WITH LIQUID CRYOGEN REFRIGERANT AND METHOD

(75) Inventor: Jeffrey S. Brooks, Jasper, GA (US)

(73) Assignee: Chart Inc., Garfield Heights, OH (US)

( * ) Notice: Subject to any disclaimer, the term of this patent is extended or adjusted under 35 U.S.C. 154(b) by 350 days.

(21) Appl. No.: 12/726,910

(22) Filed: Mar. 18, 2010

(65) Prior Publication Data

US 2011/0225984 A1 Sep. 22, 2011

(51) Int. Cl.
*F25B 19/00* (2006.01)

(52) U.S. Cl.
USPC ..... 62/51.1; 62/151; 62/381

(58) Field of Classification Search
USPC ..... 62/52.1, 50.2, 50.4, 50.7, 62, 63, 62/150, 151
See application file for complete search history.

(56) References Cited

U.S. PATENT DOCUMENTS

| | | | | | |
|---|---|---|---|---|---|
| 2,007,251 | A | * | 7/1935 | Kniskern | 62/49.1 |
| 3,166,913 | A | * | 1/1965 | Carter | 62/56 |
| 3,640,082 | A | | 2/1972 | Dehne | |
| 3,782,133 | A | * | 1/1974 | Desperier et al. | 62/381 |
| 4,277,949 | A | | 7/1981 | Longsworth | |
| 4,317,665 | A | | 3/1982 | Prentice | |
| 4,343,634 | A | * | 8/1982 | Davis | 62/62 |
| 4,344,291 | A | | 8/1982 | Tyree, Jr. et al. | |
| 4,356,707 | A | | 11/1982 | Tyree, Jr. et al. | |
| 4,528,819 | A | | 7/1985 | Klee | |
| 4,621,500 | A | * | 11/1986 | Pagani et al. | 62/53.2 |
| 4,739,623 | A | | 4/1988 | Tyree, Jr. et al. | |
| 4,991,402 | A | * | 2/1991 | Saia, III | 62/52.1 |
| 5,327,729 | A | * | 7/1994 | Yanai et al. | 62/606 |
| 5,373,702 | A | * | 12/1994 | Kalet et al. | 62/50.2 |
| 5,396,777 | A | | 3/1995 | Martin | |
| 5,605,049 | A | | 2/1997 | Moore et al. | |
| 5,694,776 | A | | 12/1997 | Sahm | |
| 6,006,525 | A | * | 12/1999 | Tyree, Jr. | 62/50.6 |
| 6,432,174 | B1 | | 8/2002 | Heung | |
| 6,438,969 | B1 | | 8/2002 | Laskaris et al. | |
| 6,484,516 | B1 | | 11/2002 | Agrawal et al. | |
| 2003/0019224 | A1 | | 1/2003 | Vander Woude et al. | |
| 2003/0029179 | A1 | | 2/2003 | Vander Woude et al. | |
| 2004/0000153 | A1 | | 1/2004 | Bagley | |
| 2004/0020228 | A1 | | 2/2004 | Waldschmidt et al. | |
| 2005/0086974 | A1 | | 4/2005 | Steinbach et al. | |
| 2005/0120736 | A1 | | 6/2005 | Kamm | |
| 2006/0053825 | A1 | | 3/2006 | Owen et al. | |
| 2006/0065004 | A1 | | 3/2006 | Lee | |
| 2006/0168976 | A1 | | 8/2006 | Flynn et al. | |
| 2009/0266100 | A1 | | 10/2009 | Viegas | |

* cited by examiner

*Primary Examiner* — John Pettitt
(74) *Attorney, Agent, or Firm* — R. Blake Johnston, Esq.; DLA Piper LLP US

(57) ABSTRACT

A freezer that uses liquid cryogen as a refrigerant includes an inner vessel defining a storage chamber and an outer jacket generally surrounding the inner vessel so that an insulation space is defined there between. A heat exchanger is positioned in a top portion of the storage chamber and has an inlet in communication with a supply of the liquid cryogen refrigerant so that the liquid cryogen refrigerant selectively flows through the heat exchanger to cool the storage chamber while being vaporized. A purge line is in communication with the outlet of the heat exchanger and includes a purge outlet positioned over the exterior of the heat exchanger. A purge valve is positioned within the purge line so that the vaporized liquid cryogen from the heat exchanger is selectively directed to the exterior of the heat exchanger to reduce ice formation on the heat exchanger.

22 Claims, 2 Drawing Sheets

FREEZER WITH LIQUID CRYOGEN REFRIGERANT AND METHOD

FIELD OF THE INVENTION

The present invention generally relates to freezers and, more particularly, to freezers that use liquid cryogen as a refrigerant.

BACKGROUND

Freezers for storing biological specimens, samples, materials, products and the like often use cryogenic liquids as a refrigerant. Such freezers typically feature a reservoir of a liquid cryogen, such as liquid nitrogen, in the bottom of the freezer storage chamber with the product stored above the reservoir or partly submerged with in the cryogenic liquid. The freezers typically also feature a double-walled, vacuum insulated construction so that the storage chamber is well insulated. Such freezers provide storage temperatures ranging from approximately −90° C. to −195° C.

A disadvantage of prior art liquid cryogen freezers is that the temperature cannot be directly controlled. The temperature is controlled by maintaining the amount of cryogenic liquid in the reservoir. The temperature of the freezer storage compartment thus varies dependent upon the amount of liquid cryogen in the freezer.

A further disadvantage of prior art liquid cryogen freezers is that there is some concern that submerging biological specimens in the cryogenic liquid presents a risk of cross-contamination between specimen containers. Even when the stored specimen containers are placed in the cold vapor above the cryogenic liquid reservoir, there is still the potential for the specimen containers to come into contact with, or be submerged within, the cryogenic liquid if the freezer is overfilled with the cryogenic liquid.

Also available are freezers that use mechanical refrigeration systems in place of a liquid cryogen reservoir. The mechanical refrigeration systems typically include a compressor, an evaporator, a condenser and a fan. Air is circulated through the storage chamber and across a cooling coil to maintain the desired temperature in the freezer storage chamber. The freezers normally do not feature vacuum insulation and employ materials such as foam and/or fiberglass insulation to insulate the storage chamber. Such freezers typically provide storage temperatures in the −40° C. to −80° C. range.

A disadvantage of the mechanical freezer is that the mechanical refrigeration system requires a significant amount of electrical power to maintain the desired temperature within the freezer storage chamber. Furthermore, mechanical refrigeration systems remove heat from the storage chamber and reject it to the environment around the freezer. This adds significant heat to the room within which the freezer is stored so that additional air conditioning capacity is required for the room. This adds additional electrical power requirements to the facility. In addition, in the event of a power failure, the storage chamber will warm rapidly, which could result in the loss of the stored biological materials.

DETAILED DESCRIPTION OF EMBODIMENTS

Figure 1:
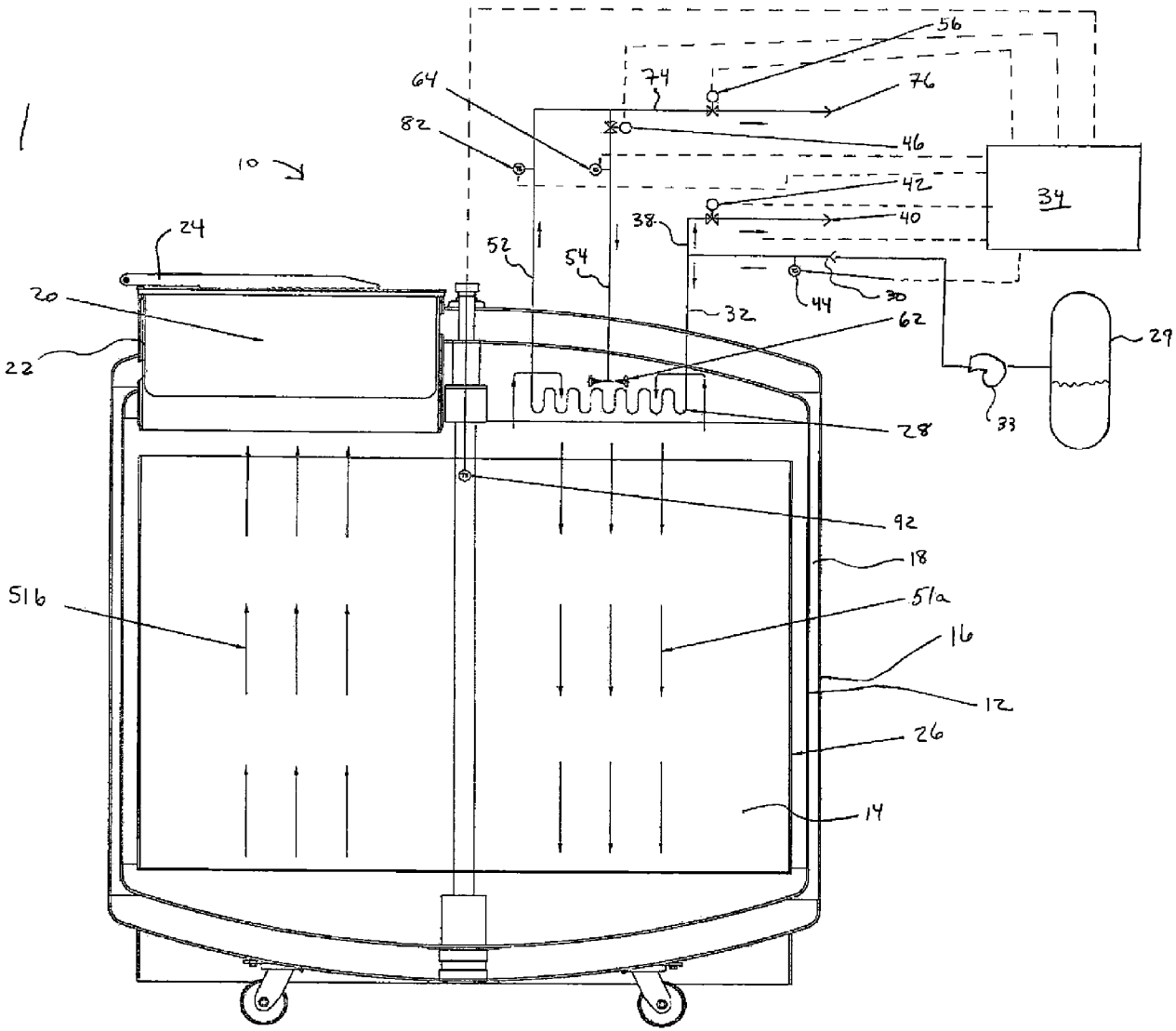
FIG. 1 is a schematic of an embodiment of the freezer with liquid cryogen refrigerant of the present invention.

An embodiment of the freezer with liquid cryogen refrigerant of the invention is indicated in general at 10 in FIG. 1.

The freezer includes an inner vessel 12 which defines storage chamber 14. An outer jacket 16 generally surrounds the vessel 12 so that an insulation space 18 is defined between the inner vessel 12 and the outer jacket 16. A vacuum is preferably drawn on the insulation space 18 so that the storage chamber 14 is insulated. In an alternative embodiment, the vacuum insulation space 18 may be supplemented, or replaced, by insulation materials known in the art including, but not limited to, foam or fiberglass.

An insulated plug or lid 20 is removably positioned within an offset access opening 22 of the freezer which permits access to the storage chamber 14. The lid 20 is preferably mounted to the remaining portion of the freezer by hinged bracket 24. A rotating tray 26 is positioned within the storage chamber 14 and holds the items being stored while also providing access through offset access opening 22 when the lid 20 is open.

The storage chamber 14 of the freezer, and thus the items stored therein, are cooled by a heat exchanger positioned within a top portion of the storage chamber. The heat exchanger preferably takes the form of a cooling coil 28, but alternative heat exchanger components or structures could be used instead.

A storage container 29 containing a supply of liquid cryogen refrigerant is in communication with the inlet 30 of feed line 32. Feed line 32 communicates with the inlet of cooling coil 28. While liquid nitrogen is discussed below as the liquid cryogen refrigerant, it should be understood that alternative cryogenic liquids could be substituted for the liquid nitrogen. The liquid nitrogen is pressurized for transfer to the inlet 30 of the feed line 32 such as by a pump 33. Alternatively, the liquid nitrogen could be stored under pressure in storage container 29 so that no pump is needed. Other alternatives for supplying cryogenic liquid under pressure are known in the art and may be used as well.

With regard to operation of the freezer of FIG. 1, all of the valves of the freezer initially are closed. When cooling of the storage chamber 14 is desired, the operator initiates the cooling cycle via electronic controller 34. Controller 34 may be a microprocessor or any other electronic control device known in the art. As illustrated by block 43 of FIG. 2, the controller 34 of FIG. 1 opens the automated bypass valve 42 so that liquid nitrogen flows through the inlet 30 of feed line 32.

There will initially be gas in the transfer line connecting the inlet 30 of the feed line with the source of pressurized liquid nitrogen. This gas normally will be warmer than the storage chamber of the freezer. To prevent this gas from entering the heat exchanger, a bypass line 38 having an outlet 40 also communicates with a portion of the feed line 32 positioned between the inlet of the cooling coil 28 and the inlet 30 of the feed line. When the controller opens bypass valve 42, the warm gas that enters through inlet 30 is vented through the bypass line 38 and outlet 40.

The temperature of the gas entering the feed line 32 is monitored by feed temperature sensor 44, which also communicates with controller 34. When the temperature of the incoming gas (indicated as $T_G$ in decision block 45 of FIG. 2) has cooled to a temperature below that of the freezer storage chamber 14 (indicated as $T_{CH}$ in decision block 45 of FIG. 2), the controller closes bypass valve 42 and a purge gas valve 46 is opened, as indicated at 48 and 50, respectively, in FIG. 2.

As a result, liquid nitrogen refrigerant flows through the cooling coil 28. The liquid nitrogen flowing through the cooling coil is colder than the gas inside of storage chamber 14 so that it absorbs heat from inside of the chamber. As the liquid nitrogen absorbs the heat, it is vaporized and exits the heat exchanger taking the absorbed heat with it.

As illustrated by arrows 51*a* and 51*b* in FIG. 1, the resulting cold gas surrounding the heat exchanger inside the storage chamber circulates throughout the chamber via natural convection. More specifically, the higher density cold gas from the top portion of the chamber within which the cooling coil is positioned descends (arrows 51*a*) thus forcing warmer lower density gas to rise (arrows 51*b*) to be cooled by the cooling coil.

As illustrated in FIG. 1, the open purge gas valve 46 is positioned on the outlet side of the heat exchanger. The vaporized nitrogen refrigerant exits the outlet of the heat exchanger through exit line 52 and travels into purge line 54, since exhaust valve 56 is in a closed condition. Purge line 54 is provided with purge outlets 62 positioned adjacent to and over the cooling coil so that the nitrogen gas exits the purge line as a purge gas and provides additional cooling to the storage chamber 14.

In addition, ice formation on the exterior surface of the cooling coil 28 can insulate it from the storage chamber of the freezer and reduce the coil's cooling effectiveness. The nitrogen purge gas exiting the purge outlets 62 above the cooling coil 28 is a dry gas. This dry nitrogen purge gas displaces ambient air (which could contain water) from the space around the exterior surface of the cooling coil to reduce the possibility of ice forming on the coil. Furthermore, when the process of FIG. 2 is performed, the purge typically continues until a sufficient amount of dry nitrogen purge gas is introduced to the chamber to displace any moist air in the chamber.

To prevent purge gas that is substantially colder than the desired storage chamber temperature of the freezer from discharging into the chamber 14, the controller 34 monitors the temperature of the purge gas via a purge gas temperature sensor 64. When the temperature of the purge gas (indicated as $T_P$ in decision block 66 of FIG. 2) traveling through purge line 54 is cooled to the minimum desired temperature of the storage chamber of the freezer (indicated as $T_{Dmin}$ in decision block 66 of FIG. 2), the purge gas valve 46 is closed by the controller 34, as indicated at 72 in FIG. 2.

Figure 2:
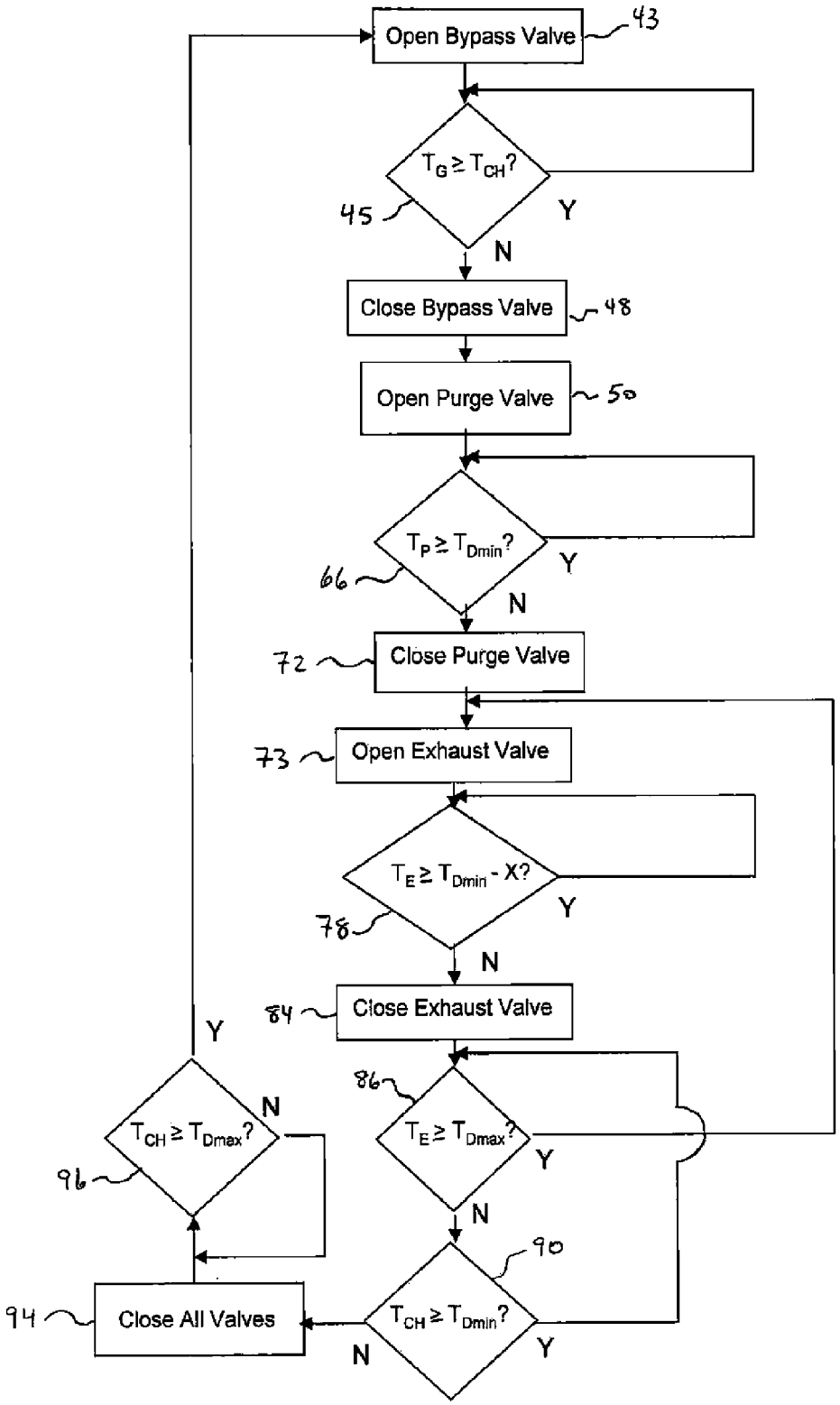
FIG. 2 is a flow chart showing the processing performed by the controller of FIG. 1.

When the purge gas valve 46 is closed, the cooling gas exhaust valve 56 is opened by the controller 34, as indicated at 73 in FIG. 2, to vent nitrogen gas from the cooling coil external to the freezer via the exhaust line 74 and exhaust vent 76. As long as the cooling coil 28 is at a temperature less than that of the gas inside of the storage chamber 14, convection cooling will occur.

The controller 34 monitors the exhaust gas temperature via an exhaust gas temperature sensor 82. When the temperature of the nitrogen exhaust gas flowing through exit line 52 and exhaust line 74 (indicated as $T_E$ in decision block 78 of FIG. 2) cools to a temperature approximately 10° C. to 20° C. below the minimum desired storage chamber temperature of the storage chamber (indicated as $T_{Dmin}-X$ in decision block 78 of FIG. 2), the exhaust valve 56 is closed by the controller, as indicated at 84 in FIG. 2, so that the flow of liquid nitrogen into the cooling coil is paused. The nitrogen (liquid or gaseous) in the cooling coil then absorbs heat from the chamber and expands or evaporates so that no-flow cooling is accomplished. While the predetermined amount X above and in decision block 78 of FIG. 2 is preferably approximately 10° C. to 20° C., alternative temperature amounts may be used instead.

The exhaust gas temperature sensor 82 is positioned external to the freezer. As a result, it is warmed by ambient external air while there is no flow through the cooling coil 28. Once the exhaust gas temperature sensor detects that the gas within line 52 has warmed above the maximum desired storage chamber temperature (indicated as $T_{Dmax}$ in decision block 86 of FIG. 2), the exhaust valve 56 is again opened by the controller.

As indicated by decision block 90 of FIG. 2, the exhaust valve 56 is cycled in accordance with the above until the freezer storage chamber 14 cools to the minimum desired temperature as measured by a chamber temperature sensor 92. At that time, as indicated at decision block 94, all valves are closed and the controller simply monitors the storage chamber temperature.

As indicated by decision block 96, when the storage chamber temperature of the storage chamber again warms to the maximum desired temperature, as measured by the chamber temperature sensor 92, the bypass valve 42 is again opened by the controller and the process of FIG. 2 begins again.

The freezer of FIGS. 1 and 2 therefore removes heat from the storage chamber by vaporizing the liquid nitrogen in the cooling coil and then venting the gas outside of the freezer, and outside of the room within which the freezer is located, if desired. The gas created by vaporizing the liquid nitrogen can only be warmed to the temperature of the freezer storage chamber instead of above ambient as is the case with the refrigerant of a typical prior art mechanical freezer. As a result, no heat is added to the room within which the freezer is located to increase the air conditioning required for the room.

The freezer of FIGS. 1 and 2 also allows for control of the freezer temperature, not possible with typical prior art liquid cryogen freezers, without the disadvantages of a mechanical freezer. In addition, the freezer of FIGS. 1 and 2 prevents the stored product from making contact with and/or being submerged within the liquid cryogen by removing the liquid cryogen from the storage chamber of the freezer.

The freezer of FIGS. 1 and 2 also eliminates the mechanical refrigeration components used by typical prior art mechanical freezers and thus the associated large electrical power requirements. Minimal power is required by the freezer of FIGS. 1 and 2 to operate the controller that monitors and controls the freezer and the associated solenoid valves required for operation.

Furthermore, in the event of a power failure, the freezer of FIGS. 1 and 2 is not immediately effected. Since the freezer incorporates a vacuum-insulated storage chamber, the storage chamber temperature is maintained over a longer period of time, thus requiring infrequent cooling cycles as opposed to the continuous cooling required by typical prior art mechanical freezers. This provides sufficient time to address power failure issues before the storage temperature inside the freezer is effected.

While the preferred embodiments of the invention have been shown and described, it will be apparent to those skilled in the art that changes and modifications may be made therein without departing from the spirit of the invention, the scope of which is defined by the appended claims.

What is claimed is:

1. A freezer for using liquid cryogen as a refrigerant comprising:

a) an inner vessel defining a storage chamber;

b) an outer jacket generally surrounding the inner vessel so that an insulation space is defined there between;

c) a heat exchanger positioned in the storage chamber, said heat exchanger having an outlet and an inlet adapted to communicate with a supply of the liquid cryogen refrigerant so that the liquid cryogen refrigerant may flow through the heat exchanger to cool the storage chamber while being vaporized;

d) a purge line in communication with the outlet of the heat exchanger, said purge line including a purge outlet positioned adjacent to an exterior of the heat exchanger;

e) a purge valve positioned within the purge line so that the vaporized liquid cryogen from the heat exchanger may be selectively directed to the exterior of the heat exchanger to reduce ice formation on the heat exchanger;

f) an exhaust line in communication with the outlet of the heat exchanger and the purge line;

g) the exhaust line having an exhaust vent;

h) an exhaust valve positioned within the exhaust line;

i) a feed line in communication with the inlet of the heat exchanger and adapted to communicate with the supply of liquid cryogen;

j) as bypass line in communication with the feed line;

k) a bypass valve positioned in the bypass line;

l) a feed temperature sensor in communication with the feed line;

m) a purge gas temperature sensor in communication with the purge line;

n) an exhaust gas temperature sensor in communication with the exhaust line;

o) a chamber temperature sensor in communication with the storage chamber;

p) a controller in communication with the feed, purge gas, exhaust gas and chamber temperature sensors and the bypass, purge and exhaust valves, said controller programmed to:

i. open the bypass valve when a temperature of gas flowing through the feed line is higher than a temperature of the storage chamber;

ii. close the bypass valve when the temperature of gas flowing through the feed line is lower than the temperature of the storage chamber;

iii. open the purge valve and close the exhaust valve when a temperature of gas flowing through the purge line is greater than a minimum desired temperature of the storage chamber;

iv. close the purge valve and open the exhaust valve when the temperature of gas flowing through the purge line is lower than the minimum desired temperature of the storage chamber;

v. close the exhaust valve when a temperature of gas flowing through the exhaust line is lower than the minimum desired temperature of the storage chamber by a predetermined amount; and vi. close all valves when a temperature of the storage chamber is less than the minimum desired temperature.

2. The freezer of claim 1 wherein the predetermined amount of p)v is approximately 10° C.

3. The freezer of claim 1 wherein the heat exchanger is a cooling coil.

4. The freezer of claim 1 wherein the purge outlet is positioned over the heat exchanger.

5. The freezer of claim 1 wherein the liquid cryogen refrigerant is liquid nitrogen.

6. The freezer of claim 1 wherein the insulation space is a vacuum insulation space.

7. The freezer of claim 1 further comprising an access opening formed through the inner vessel and the outer jacket and a lid for removably closing the access opening.

8. The freezer of claim 7 further comprising a rotating tray positioned within the storage chamber.

9. A freezer for using liquid cryogen as a refrigerant comprising:

a) an inner vessel defining a storage chamber;

b) an outer jacket generally surrounding the inner vessel so that an insulation space is defined there between;

c) a heat exchanger positioned in the storage chamber, said heat exchanger having an outlet and an inlet adapted to communicate with a supply of the liquid cryogen refrigerant so that the liquid cryogen refrigerant may flow through the heat exchanger to cool the storage chamber while being vaporized;

d) a purge hue in communication with the outlet of the heat exchanger, said purge line including a purge outlet positioned adjacent to an exterior of the heat exchanger;

e) a purge valve positioned within the purge line so that the vaporized liquid cryogen from the heat exchanger may be selectively directed to the exterior of the heat exchanger to reduce ice formation on the heat exchanger;

f) an exhaust line in communication with the outlet of the heat exchanger and the purge line;

g) the exhaust line having an exhaust vent;

h) an exhaust valve positioned within the exhaust line;

i) a purge gas temperature sensor in communication with the purge line;

j) an exhaust gas temperature sensor in communication with the exhaust line;

k) a chamber temperature sensor in communication with the storage chamber;

l) a controller in communication with the purge gas, exhaust gas and chamber temperature sensors and the purge and exhaust valves, said controller programmed to:

i. open the purge valve and close the exhaust valve when a temperature of gas flowing through the purge line is greater than a minimum desired temperature of the storage chamber;

ii. close the purge valve and open the exhaust valve when the temperature of gas flowing through the purge line is lower than the minimum desired temperature of the storage chamber, iii. close the exhaust valve when a temperature of gas flowing through the exhaust line is lower than the minimum desired temperature of the storage chamber by a predetermined amount; and iv. close all valves when a temperature of the storage chamber is less than the minimum desired temperature.

10. The freezer of claim 9 wherein the predetermined amount of l)iii is approximately 10° C. to 20° C.

11. The freezer of claim 9 wherein the heat exchanger is a cooling coil.

12. The freezer of claim 9 wherein the purge outlet is positioned over the heat exchanger.

13. The freezer of claim 9 wherein the liquid cryogen refrigerant is liquid nitrogen.

14. The freezer of claim 9 wherein the insulation space is a vacuum insulation space.

15. The freezer of claim 9 further comprising an access opening formed through the inner vessel and the outer jacket and a lid for removably closing the access opening.

16. The freezer of claim 15 further comprising a rotating tray positioned within the storage chamber.

17. A freezer comprising:

a) an inner vessel defining a storage chamber;

b) an outer jacket generally surrounding the inner vessel so that an insulation space is defined there between;

c) a supply of liquid cryogen refrigerant;

d) a heat exchanger positioned in the storage chamber, said heat exchanger having an outlet and an inlet in communication with the supply of the liquid cryogen refrigerant so that the liquid cryogen refrigerant selectively flows through the heat exchanger to cool the storage chamber while being vaporized;

e) a purge line in communication with the outlet of the heat exchanger, said purge line including a purge outlet positioned adjacent to an exterior of the heat exchanger; and f) a purge valve positioned within the purge line so that the vaporized liquid cryogen from the heat exchanger is selectively directed to the exterior of the heat exchanger to reduce ice formation on the heat exchanger;

g) an exhaust line in communication with the outlet of the heat exchanger and the purge line;

h) the exhaust line having an exhaust vent;

i) an exhaust valve positioned within the exhaust line;

j) a feed line in communication with the inlet of the heat exchanger and the supply of liquid cryogen;

k) a bypass line in communication with the feed line;

l) a bypass valve positioned in the bypass line;

m) a feed temperature sensor in communication with the feed line;

n) a purge gas temperature sensor in communication with the purge line;

o) an exhaust gas temperature sensor in communication with the exhaust line;

p) a chamber temperature sensor in communication with the storage chamber;

q) a controller in communication with the feed, purge gas, exhaust gas and chamber temperature sensors and the bypass, purge and exhaust valves, said controller programmed to:

i. open the bypass valve when a temperature of gas flowing through the feed line is higher than a temperature of the storage chamber;

ii. close the bypass valve when the temperature of gas flowing through the feed line is lower than the temperature of the storage chamber;

iii. open the purge valve and close the exhaust valve when a temperature of gas flowing through the purge line is greater than a minimum desired temperature of the storage chamber;

iv. close the purge valve and open the exhaust valve when the temperature of gas flowing through the purge line is lower than the minimum desired temperature of the storage chamber;

v. close the exhaust valve when a temperature of gas flowing through the exhaust line is lower than the minimum desired temperature of the storage chamber by a predetermined amount; and vi. close all valves when a temperature of the storage chamber is less than the minimum desired temperature.

18. The freezer of claim 17 wherein the predetermined amount of q)v is approximately 10° C. to 20° C.

19. The freezer of claim 17 wherein the supply of liquid cryogen refrigerant includes a pressurized container containing the liquid cryogen refrigerant.

20. The freezer of claim 17 wherein the supply of liquid cryogen refrigerant includes a container containing the liquid cryogen and a pump in circuit between the container and the heat exchanger inlet.

21. A freezer comprising:

a) an inner vessel defining a storage chamber;

b) an outer jacket generally surrounding the inner vessel so that an insulation space is defined there between;

c) a supply of liquid cryogen refrigerant;

d) a heat exchanger positioned in the storage chamber, said heat exchanger having an outlet and an inlet in communication with the supply of the liquid cryogen refrigerant so that the liquid cryogen refrigerant selectively flows through the heat exchanger to cool the storage chamber while being vaporized;

e) a purge line in communication with the outlet of the heat exchanger, said purge line including a purge outlet positioned adjacent to an exterior of the heat exchanger;

f) a purge valve positioned within the purge line so that the vaporized liquid cryogen from the heat exchanger is selectively directed to the exterior of the heat exchanger to reduce ice formation on the heat exchanger;

g) an exhaust line in communication with the outlet of the heat exchanger and the purge line;

h) the exhaust line having an exhaust vent;

i) an exhaust valve positioned within the exhaust line;

j) a purge gas temperature sensor in communication with the purge line;

k) an exhaust gas temperature sensor in communication with the exhaust line;

l) a chamber temperature sensor in communication with the storage chamber;

m) a controller in communication with the purge gas, exhaust gas and chamber temperature sensors and the purge and exhaust valves, said controller programmed to:

i. open the purge valve and close the exhaust valve when a temperature of gas flowing through the purge line is greater than a minimum desired temperature of the storage chamber;

ii. close the purge valve and open the exhaust valve when the temperature of gas flowing through the purge line is lower than the minimum desired temperature of the storage chamber;

iii. close the exhaust valve when a temperature of gas flowing through the exhaust line is lower than the minimum desired temperature of the storage chamber by a predetermined amount; and iv. close all valves when a temperature of the storage chamber is less than the minimum desired temperature.

22. The freezer of claim 21 wherein the predetermined amount of m)iii is approximately 10° C.

* * * * *